US009127635B2

(12) United States Patent
Sumida et al.

(10) Patent No.: US 9,127,635 B2
(45) Date of Patent: Sep. 8, 2015

(54) METHOD OF GENERATING SPRAY BY FLUID INJECTION VALVE, FLUID INJECTION VALVE, AND SPRAY GENERATION APPARATUS

(75) Inventors: Mamoru Sumida, Chiyoda-ku (JP); Tatsuya Nakayama, Chiyodu-ku (JP); Norihisa Fukutomi, Chiyoda-ku (JP); Keisuke Ito, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 533 days.

(21) Appl. No.: 13/281,082

(22) Filed: Oct. 25, 2011

(65) Prior Publication Data

US 2012/0325922 A1 Dec. 27, 2012

(30) Foreign Application Priority Data

Jun. 22, 2011 (JP) ..... 2011-138111

(51) Int. Cl.
*F02D 1/06* (2006.01)
*F02M 61/00* (2006.01)
*F02M 61/18* (2006.01)

(52) U.S. Cl.
CPC ..... *F02M 61/1806* (2013.01); *F02M 61/18* (2013.01); *F02M 61/186* (2013.01); *F02M 61/1846* (2013.01); *F02M 61/1853* (2013.01)

(58) Field of Classification Search
CPC ..... F02M 61/1806; F02M 61/1813; F02M 61/1853; F02M 61/186; F02M 61/1866; F02M 51/0671; F02M 51/0678
USPC ..... 239/5, 533, 12, DIG. 7
See application file for complete search history.

(56) References Cited

U.S. PATENT DOCUMENTS 4,519,423 A * 5/1985 Ho et al. ..... 137/888
4,957,242 A * 9/1990 Schadow et al. ..... 239/590
5,271,358 A * 12/1993 Katoh et al. ..... 123/73 PP
6,186,418 B1 * 2/2001 Tani ..... 239/533.2
6,708,904 B2 * 3/2004 Itatsu ..... 239/533.12

(Continued)

FOREIGN PATENT DOCUMENTS

JP 2517136 Y2 8/1996
JP 2000-104647 A 4/2000

(Continued)

*Primary Examiner* — Len Tran
*Assistant Examiner* — Alexander Valvis
(74) *Attorney, Agent, or Firm* — Sughrue Mion, PLLC; Richard C. Turner

(57) ABSTRACT

A method of generating a spray by a fluid injection valve is provided. The fluid injection valve includes a valve seat (10), a valve body (8), and an orifice plate (11) having a plurality of orifices (12). The flows in the orifices and the flows directly below the orifices are configured to be substantially liquid film flows. The directions of jet flows (30), (31) from the respective orifices (12) are not necessarily matched to the central axis directions of the orifices and are not necessarily intersected with each other at a downstream position thereof. The sprays are caused to converge by the Coanda effect acting on a plurality of sprays after jet flows from the orifices (12) become sprays at a downstream position farther than a break-up length (a). The convergence of the sprays is continued until the Coanda effect is substantially lost.

21 Claims, 17 Drawing Sheets

(56) References Cited

U.S. PATENT DOCUMENTS

| | | | | |
|---|---|---|---|---|
| 6,848,636 | B2 * | 2/2005 | Munezane et al. | 239/533.12 |
| 6,994,279 | B2 * | 2/2006 | Saito et al. | 239/533.12 |
| 7,093,776 | B2 * | 8/2006 | Schneider | 239/533.12 |
| 7,201,334 | B2 * | 4/2007 | Sasaki et al. | 239/585.5 |
| 7,565,894 | B2 | 7/2009 | Oda et al. | |
| 7,607,458 | B2 * | 10/2009 | Arnold et al. | 138/177 |
| 7,810,745 | B2 | 10/2010 | Oomura et al. | |
| 8,104,450 | B2 * | 1/2012 | Gentile | 123/298 |
| 2004/0164187 | A1 | 8/2004 | Kihara et al. | |
| 2007/0056555 | A1 | 3/2007 | Oda et al. | |
| 2008/0169367 | A1 | 7/2008 | Oomura et al. | |
| 2010/0237174 | A1 * | 9/2010 | Oomori et al. | 239/533.12 |

FOREIGN PATENT DOCUMENTS

| | | | |
|---|---|---|---|
| JP | 2001-263206 | A | 9/2001 |
| JP | 2003074440 | A | 3/2003 |
| JP | 2004-225598 | A | 8/2004 |
| JP | 2005-207236 | A | 8/2005 |
| JP | 2005-233145 | A | 9/2005 |
| JP | 2005-264757 | A | 9/2005 |
| JP | 2005-282420 | A | 10/2005 |
| JP | 2007-040111 | A | 2/2007 |
| JP | 2007-077809 | A | 3/2007 |
| JP | 2007-138780 | A | 6/2007 |
| JP | 2008-169766 | A | 7/2008 |
| JP | 2010-249125 | A | 11/2010 |

* cited by examiner

METHOD OF GENERATING SPRAY BY FLUID INJECTION VALVE, FLUID INJECTION VALVE, AND SPRAY GENERATION APPARATUS

BACKGROUND OF THE INVENTION

1. Field of the Invention

The present invention relates to a method of generating a spray that is suitable for a fuel injection valve for, for example, an internal combustion engine (hereinafter referred to as an "engine"). The invention also relates to a fluid injection valve and a spray generation apparatus.

2. Description of the Related Art

In recent years, research and development have been carried out actively in the field of engines for vehicles such as automobiles to reduce emission gas during engine cold time through atomization of fuel spray and to improve fuel consumption through improving combustibility.

The fuel injection system of gasoline engine is classified into two systems, a port injection system and an in-cylinder injection system.

The important three elements to establish the combustion concept of the in-cylinder injection system are the spray specifications (including the injection position), the in-cylinder air flow movement, and the combustion chamber shape.

It is only after the matching of these elements becomes possible that the combustion concept can be established. However, because the internal pressure of the cylinder and the in-cylinder air flow movement change depending on the engine rotational frequency or the load, and the fuel injection amount and the injection timing are changed correspondingly, the spray profile and spray behavior in the cylinder also change accordingly. Therefore, it is a difficult task to match the three elements and at the same time to prevent the adherence of sprayed fuel to the cylinder inner wall surface under various operating conditions, with the constraints of the layout in the engine room.

Likewise, in the port injection system, the spray specifications (including the injection position), the intake air flow movement, and the intake port shape are the three elements for achieving the optimum injection system, like the three elements for establishing the combustion concept of the in-cylinder injection system.

The common port injection system has a configuration in which, in the case of two intake valves, two-direction sprays corresponding thereto are used to inject the fuel targeting the intake valves. Moreover, development has been carried out to achieve a spray shape or a spray direction targeting such that the spray does not adhere to the intake port wall surface by improving atomization of the spray. However, the intake port shape and the accompanying intake air flow movement cannot necessarily be optimized because of the constraints of the layout in the engine room. Therefore, no technique for achieving both the improvement in the atomization of the spray and the spray shape/injection direction targeting has been disclosed clearly.

Furthermore, there are many middle or large-sized motorcycles in which the fuel injection aiming at the intake valves cannot be carried out because of the constraints of the lay-out. It is not necessarily clear what type of injection system concept is optimum in that case. Therefore, a future development effort has been expected.

Moreover, small-sized motorcycles, outboard engines, and multi-purpose engines are in a transitional period from the carburetor to the port injection system, and many of them have an engine with one intake valve. In reality, because of the problems associated with the lay-out, they have an injection configuration such that the intake valve may or may not be targeted by a unidirectional spray (one spray). However, it is clear that the emission gas reduction and the fuel consumption improvement will be demanded more and more in the future, so the optimum specifications with reduced system costs will be required.

As described above, examples of the parameters used for the matching in the conventional port injection system of a gasoline engine are, in the case of the two-spray specification, the spray angle of each spray, the injection amount distribution image in the cross section perpendicular to the injection direction, the injection angle (narrow angle) of the two sprays, and a representative droplet diameter at a certain point in the spray.

More specifically, the cross-sectional shape of each spray perpendicular to the injection direction forms a substantially circular shape or a substantially elliptical shape. While the basic specification of the injection amount distribution thereof is set to be a substantially solid conical shaped distribution having a peak almost at the center, the improvement of atomization is attempted as needed. In reality, when the one is given priority, the other one cannot be controlled because the level of atomization and the spray angle have a correlation with each other.

The reason why the peak of the injection amount distribution is formed almost at the center is that the injection directions from the respective orifices are aimed at the direction in which they gather. For this reason, the distribution ratio tends to be relatively high in the center portion.

In the case of one spray specification as well, the related portion in the just-described content may be applied.

In view of these problems, various proposals have been made concerning nozzle or spray, as in Patent Documents 1 to 6, for example.

REFERENCES

Patent Documents

[Patent Document 1] JP-A-2005-233145
[Patent Document 2] JP-A-2004-225598
[Patent Document 3] JP-A-2008-169766
[Patent Document 4] JP-A-2005-207236
[Patent Document 5] JP-A-2007-77809
[Patent Document 6] JP-A-2000-104647

However, these proposals do not show any measure to achieve both an atomization improvement of spray and an improvement in freedom in designing spray shape, spray pattern, and injection amount distribution, so they cannot serve as the guidelines to determine the optimum spray specification in the actual circumstance in which the intake port shapes and the intake air flow movements vary from one engine specification to another.

Concerning this problem, each of the above Patent Documents will be discussed below.

In Patent Document 1, an air region between liquid columns is ensured in order to reduce the interference of liquid columns from multi-holes, and dispersion into spray is promoted to promote atomization of fuel.

The atomization is promoted by designing the arrangement of the liquid columns each like a portion of a circular cone's surface. However, in reality, it is necessary that the fuel needs to be almost in the form of liquid threads or liquid drops at the location where the liquid columns interfere with each other.

The reason is that, if the liquid columns of the fuel interfere with each other, the atomization is worsened (see paragraph 0006 of Patent Document 1).

In other words, the publication shows that the orifices merely disposed so that the location at which the liquid columns interfere with each other is located farther downstream, and it does not disclose any measure to control the spray pattern formed from plural sprays or the shape of the spray.

Accordingly, the entire spray inevitably tends to spread, reducing the freedom in designing the spray, and constraints arise on the intake port shape and the intake valve arrangement that can be adopted.

According to Patent Document 2, the center of gravity of the fuel injection amount distribution is set farther inward than the center of the spray contour of two sprays, so that the spray is targeted at an inner position of the two intake valves. Thereby, the amount of the fuel adhering to the cylinder bore wall surface is minimized when the fuel adhering to the back face of the intake valve is blown away by air flow.

However, recently, the atomization technology of the jet flow from a fuel injection valve has been developed considerably. Therefore, apart from the atomization level, the fuel is turned into a sufficiently dispersed spray at the time when it reaches the intake valve.

Thus, even with the exhaust stroke injection, the amount of the sprayed fuel drifting about in the intake port is greater than the amount of the sprayed fuel adhering to the intake port and the intake valve because of the air flow movement in the closed intake port.

Moreover, complete vaporization and complete combustion of the fuel in the cylinder may not be expected by the atomization effect obtained when the fuel passes through the flow passage of the intake valve alone, and the emission of unburnt HC cannot be reduced sufficiently.

Especially immediately after the cold start, the temperatures of the intake port and the intake valve are low, so it cannot be expected that, at these locations, the sprayed fuel and the adhering fuel are vaporized quickly.

Exhaust emission regulations are becoming more and more strict. For this reason, the adherence of fuel to the intake port and the intake valve needs to be reduced to reduce the emission of unburnt HC even if the atomization of fuel spray becomes better. The less the adherence of the injection fuel to the intake port and the intake valve, the clearer the relationship between the injection amount and the combustion performance in that cycle becomes, in other words, the clearer the relationship between the injection amount and the emission gas, the fuel consumption, and the output power becomes. As a result, it becomes possible to optimize the injection system as a whole, including the controllability.

Therefore, it is necessary that the spray be atomized as much as possible for complete vaporization and complete combustion. However, Patent Document 2 does not contain any description of the means to achieve it.

Moreover, the injection amount distribution therein is merely such an injection amount distribution schematically shown with an image in which the independent liquid column jet flows from the orifices interfere with each other moderately and are integrated with each other. The publication does not shown the injection amount distribution in the case where the liquid column jet flows from the respective orifices are dispersed and turned into sprays. Consequently, the intake port shape and the intake valve arrangement that can be adopted are unclear.

In Patent Document 3, the arrangement of orifices is designed so that the sprays from the orifices do not interfere with each other, whereby the atomization is promoted and the deviation of the injection amount distribution is reduced.

This technique, however, merely avoids the interference between sprays as in the case of Patent Document 1. Therefore, the spray pattern and the entire spray shape formed from plural sprays inevitably tend to spread, and the freedom in designing them is small, so constraints arise on the intake port shape and the intake valve arrangement.

Patent Document 3 also describes that the deviation of the injection amount distribution is reduced by also providing the orifices inside. However, it can be said so merely relatively in comparison with the case where no orifices are provided inside, and Patent Document 3 contains no description about the measure to atomize the respective independent liquid column jet flows from the orifices while avoiding the interference and obtain an injection amount distribution with reduced deviation. Therefore, the intake port shape and the intake valve arrangement that can be adopted, for example, are unclear.

Patent Document 4 describes that an atomized spray obtained by collision and a lead spray having a strong penetration distance are formed, and the latter pulls the former to prevent the spray from scattering. It also describes that it is preferable that the fuel spray concentration should be higher in an inward area than at the intake valve center position.

However, in order to cause jet flows to collide with each other to atomize them, the collision position needs to be at a position before the break-up length of the jet flows. In that case, the jet flows (sprays) need to be scattered for atomization, and also, some of the energy retained by the jet flows is converted into the surface tension of the spray particles that have been scattered, so the penetration distance decreases.

Therefore, even though the spray with a lowered penetration distance that has been scattered by collision is pulled by the lead spray with a strong penetration distance that has been simultaneously injected, the behaviors of these sprays at their tip-end portions do not match in timing, and in the case of a small injection amount with a short injection duration, the lead spray advances ahead while the spray scattered by collision is left aside.

In addition, the attracting swirl caused by the lead spray is not just the one shown in FIG. 4 of Patent Document 4, and at the same time, an annular swirl is formed at the outer circumference of the lead spray at a certain downstream position in the injection direction that is determined by the balance between the shearing force of the outer circumference of the lead spray and that of the atmosphere. As a consequence, the scattered spray is taken into the annular swirl, so that the scattered spray cannot advance farther downstream in the injection direction.

Thus, in order for the lead spray to advance while pulling the scattered atomized spray, various constraint conditions are necessary. Therefore, this technique is not suitable for the injection system for the gasoline engine that undergoes a great deal of non-steady state during the transient operation time. A technique that can improve the freedom in designing the spray pattern and the entire spray shape more easily is desired.

Patent Document 5 adopts a spray pattern by which the intake valve system is avoided and a large amount of fuel is allowed to adhere onto the intake valve's umbrella portion, and it utilizes the atomization at the time when the fuel passes through the intake valve.

However, Patent Document 5 has the same problems as those with Patent Document 2.

Patent Document 6 describes that the interference between each of the sprays is avoided while the fuel is atomized, and moreover, each of the sprays advance while being attracted to each other by the Coanda effect, whereby variations of the spray advancing directions can be prevented.

However, it is difficult to keep the balance of the spray directions in such a manner as to cause the Coanda effect to work so that each of the sprays does not spread excessively and on the other hand to restrain the Coanda effect so that each of the sprays does not gather, even under a static atmosphere condition. Moreover, within the intake port, the spray is affected by the ambient air pressure and temperature, the intake air flow movement, the flow rate of the spray volume (weight), and the spray speed. Therefore, it is very difficult to achieve such a balance in an injection system for the gasoline engine that undergoes a great deal of non-steady state during the transient operation time.

In other words, the Coanda effect here does not have an active role such as to form a compact converged spray, and the spray shape, the spray pattern, and the injection amount distribution of the entire spray are not particularly controlled.

SUMMARY OF THE INVENTION

In view of the problems such as described above, it is an object of the invention to provide a method of generating a spray by a fluid injection valve that achieves both the improvement in atomization of fuel spray and the improvement in freedom in designing the spray shape, the spray pattern, and the injection amount distribution, and to provide the fluid injection valve and a spray generation apparatus.

The invention provides a method of generating a spray by a fluid injection valve. The fluid injection valve includes a valve seat having a valve seat face in a midpoint of a fluid passage, a valve body for controlling opening/closing of the fluid passage by seating/unseating to the valve seat face, and an orifice plate located downstream from the valve seat and having plural orifices. The fluid injection valve is configured to make flows in each of the orifices and flows directly below each of the orifices substantially liquid film flows. The method, according to the invention, of generating a spray by a fluid injection valve includes: not necessarily matching directions of jet flows from each of the orifices to the central axis directions of the orifices and not necessarily intersecting the jet flows with each other at a downstream position thereof; after the jet flows from each of the orifices become sprays at a downstream position farther than a break-up length, causing the sprays to converge by the Coanda effect acting on plural sprays; and allowing the convergence of the sprays to continue until the Coanda effect is substantially lost.

According to the method of generating a spray by a fluid injection valve of the invention, the spray drifts about in the intake port in the exhaust stroke injection, and the spray flows into the cylinder, following the intake air flow movement flowing from the intake valve into the cylinder, in the intake stroke injection. As a result, the air-fuel mixture formation develops at an early stage, and it becomes easy to form a more uniform air-fuel mixture in the cylinder.

In particular, in a port injection system, a spray configuration that can be applied to a wider variety of intake port shapes and intake valve arrangements can be achieved, specifically, the atomization can be improved while the spread of the entire spray is kept compact, and at the same time, the adherence of the spray to the intake port wall surface and the intake valve can be inhibited regardless of injection timing and the like.

The foregoing and other object, features, aspects and advantages of the present invention will become more apparent from the following detailed description of the present invention when taken in conjunction with the accompanying drawings.

DETAILED DESCRIPTION OF THE INVENTION

First Preferred Embodiment

The first preferred embodiment of the invention will be described below with reference to FIGS. 1 and 2.

Figure 1:
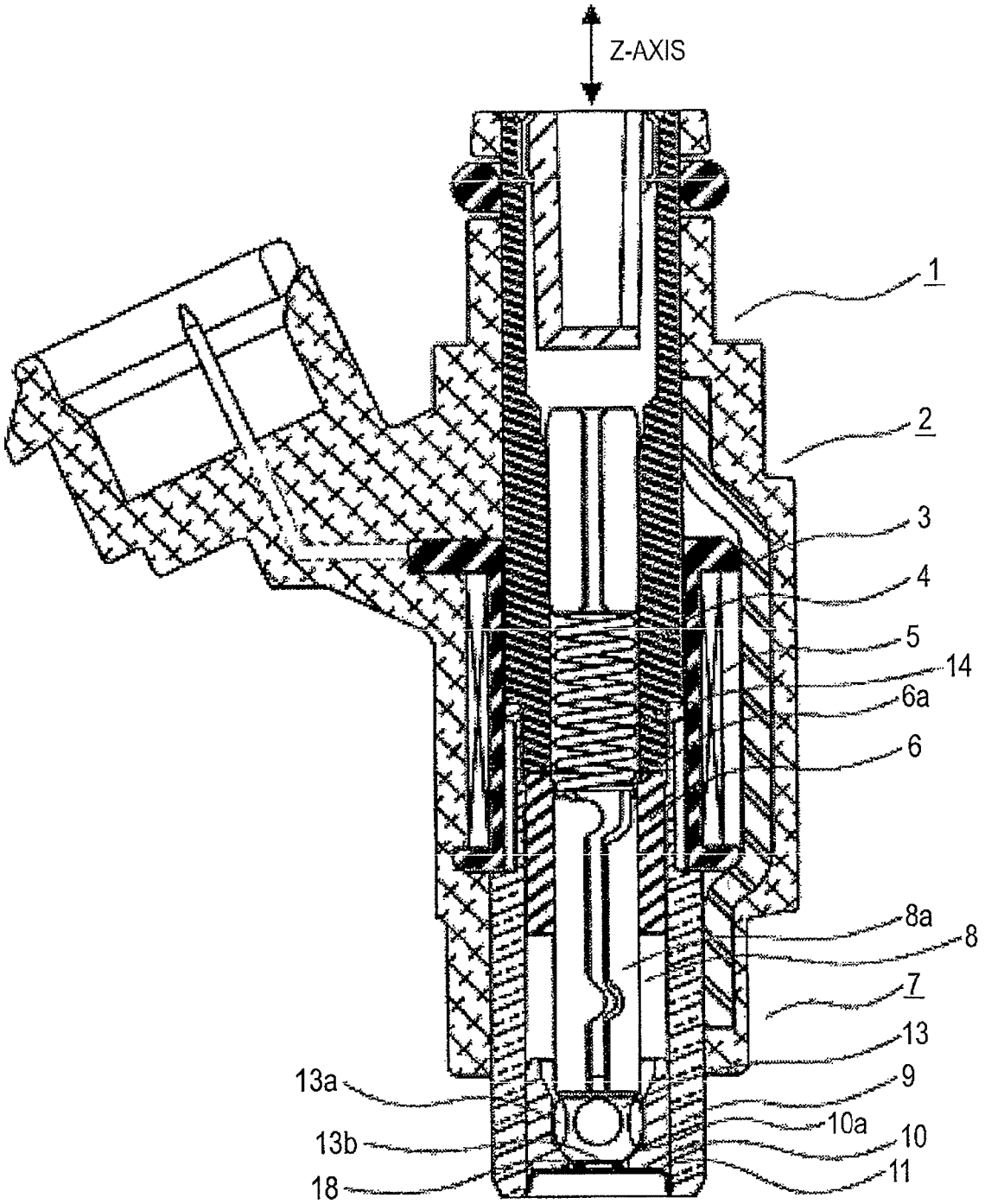
FIG. 1 is an overall cross-sectional view showing a fuel injection valve according to a first preferred embodiment of the invention.

FIG. 1 shows an overall cross-sectional view of a fuel injection valve 1. FIG. 2 is an enlarged view of a tip portion of the fuel injection valve 1 in FIG. 1. The fuel injection valve 1 is fitted to an air-intake pipe of an internal combustion engine, and pressurized fuel is supplied thereto from above.

The tip of the lower portion of the fuel injection valve 1 faces the inside of an intake port of the internal combustion engine so as to inject fuel downward.

A solenoid device 2 for generating an electromagnetic force has a housing 3 serving as a yoke portion of a magnetic circuit, a core 4 serving as a stationary iron core, a coil 5, an armature 6 serving as a movable iron core.

A valve device 7 primarily has a valve seat 10 provided inside a valve main unit 9 and at the tip portion of the fuel injection valve 1, an orifice plate 11 provided on a downstream side of the valve seat 10, a cover plate 18 provided within the valve seat 10 and on an upstream side of the orifice plate, a valve body 8 the outer periphery of which is in contact with the inner surface of the valve main body and the valve seat, and a compression spring 14 provided upstream of the valve body.

In the valve body 8, the armature 6 is provided on an upstream side of a hollow rod 8*a*, and a ball 13 is provided on a downstream side thereof.

The valve main unit 9 is press-fitted and welded to the outer diameter portion of the tip of the core 4. The rod 8*a* is press-fitted and welded to the inner surface of the armature 6.

The ball 13 is welded to the downstream side of the rod 8*a*, and the ball 13 is provided with chamfered portions 13*a* parallel to the center axis Z of the fuel injection valve.

At the tip of the fuel injection valve 1, the orifice plate 11 is welded to the tip end face of the valve seat 10 and the inner surface of the valve main unit 9. In the orifice plate 11, plural orifices 12 are opened so as to pierce through the orifice plate 11 in a plate thickness direction.

In a condition in which no electric current is passed through the coil 5, the valve body 8 is pressed downward by the compression spring 14 via the rod 8*a*, so that a ball face 13*c* is in contact with a seat portion R1 of the valve seat face, resulting in a state in which the fuel flow passage is closed.

When the valve body 8 integrated with the armature 6 starts to move upward by passing electric current through the coil 5, the ball face 13*c* moves away from the valve seat face 10*a*, forming the fuel flow passage. When an upper face 6*a* of the armature comes into contact with the core 4, the valve body 8 is in a fully-open stroke state.

Figure 2:
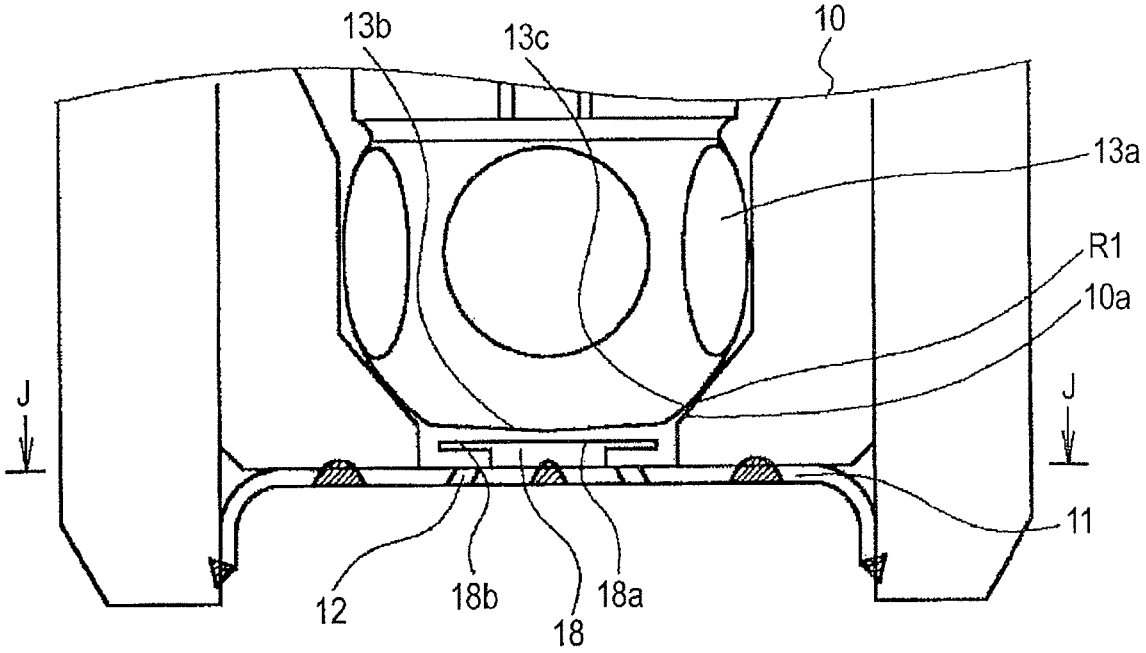
FIG. 2 is an enlarged view of the tip portion of the fuel injection valve in FIG. 1.
Figure 3:
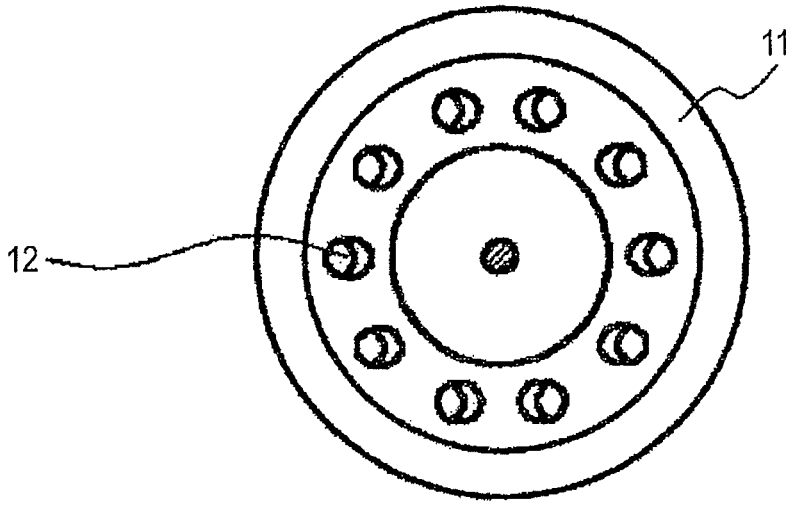
FIG. 3 is a plan view showing the orifice plate in FIG. 2.

FIG. 3 shows a plan view of the orifice plate 11 taken along line J-J in FIG. 2.

In the orifice plate 11, ten orifices 12 directed outward toward the downstream side with respect to the Z axis of the fuel injection valve 1 are arranged in an annular shape.

The orifices are divided into two injection port groups (two sprays) in which the injection port central axes or the jet flow directions are directed respectively to the left and to the right of FIG. 3, targeting intake valves of the internal combustion engine.

Next, the operation will be described.

When an operation signal is sent from a control device, not shown, of the internal combustion engine to a driving circuit of the fuel injection valve 1, electric current is passed through the coil 5 of the fuel injection valve 1, causing the armature 6 to be pulled toward the core 4 side. As a result, the ball face 13*c* of the valve body 8, having an integrated structure with the armature 6, moves away from the valve seat face 10*a*, forming a gap therebetween, and fuel injection starts.

Next, when an operation stop signal is sent from the control device of the internal combustion engine to the driving circuit of the fuel injection valve 1, the electric current passed through the coil 5 is stopped, and the valve body 8 is pressed toward the valve seat side by the compression spring 14. As a result, the ball face 13*c* and the valve seat face 10*a* are brought into a closed state, so the fuel injection is finished.

Here, the detailed positions and structures of the orifice plate 11, the cover plate 18, the valve seat 10, and the ball 13, which control the flows within the orifices to be liquid film flows by flow contraction, for example, will be described with reference to FIG. 2 and the detailed cross-sectional views of FIGS. 4 and 5.

When the valve body 8 is open, the fuel advances from the passage between the chamfered portions 13*a* of the ball 13 and the inner surface of the valve seat 10 and parallel to the Z axis toward a downstream portion through the gap between the ball face 13*c* and the valve seat face 10*a*, and reaches a seat portion R1.

The fuel flows parallel to the Z axis in an upstream region of the seat portion R1. Therefore, after passing through the seat portion R1, the fuel flow that flows along the valve seat face because of inertia becomes the main flow of the fuel, and the fuel reaches a point P1 at the downstream end of the valve seat face 10*a*. At P1, the valve seat face bends toward the valve seat inner periphery, so the main flow of the fuel is detached from the point P1.

The extension line of the valve seat face intersects with a side face of the cover plate at a point P2. The fuel detached from the point P1 advances toward the point P2, passes through an annular passage C, and flows into a radial passage B without accompanying a considerable course change in a radial direction.

As described above, the main flow of the fuel passing through the seat portion R1 flows into the annular passage C, and therefore, the flow of the fuel into a gap passage A is suppressed.

The linear line connecting the seat portion R1 with a point R2 at the inlet of an injection port 12 intersects with a thin-wall portion 18*b* of the cover plate 18, and the thin-wall portion 18*b* blocks the linear inflow of the fuel from the seat portion R1 into the injection port inlet.

For this reason, at least a portion of the fuel flowing into the orifices 12 forms a flow along the radial passage B. A terminal end face 18*d* is arranged near the orifices 12. The terminal end face 18*d* closes the flow passage of the back-flow that flows into the orifices 12 from the fuel-injection-valve center-axis side to reduce the speed of the back-flow.

Because of the suppression of the back-flow, the speed of the front face flow flowing from the seat portion side into the orifices 12 is increased relatively.

Because at least a portion of the front face flow is forced to change its course considerably in the injection port after having advanced along the radial passage B, and because the speed of the front face flow is fast, the fuel is strongly pressed against the inner surface of the injection port on the fuel-injection-valve center-axis side viewed in the injection port's cross section.

Figure 4:
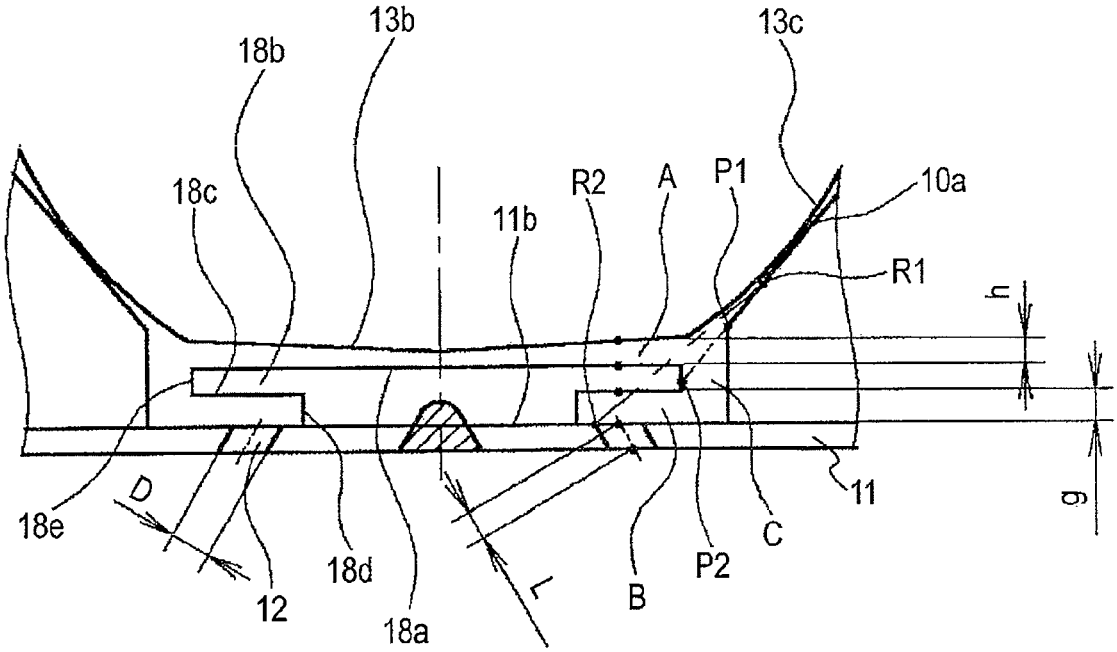
FIG. 4 is an enlarged view of the tip portion of the fuel injection valve in FIG. 1.

Note that in FIG. 4, L denotes the injection port length and D denotes the injection port diameter.

Figure 5:
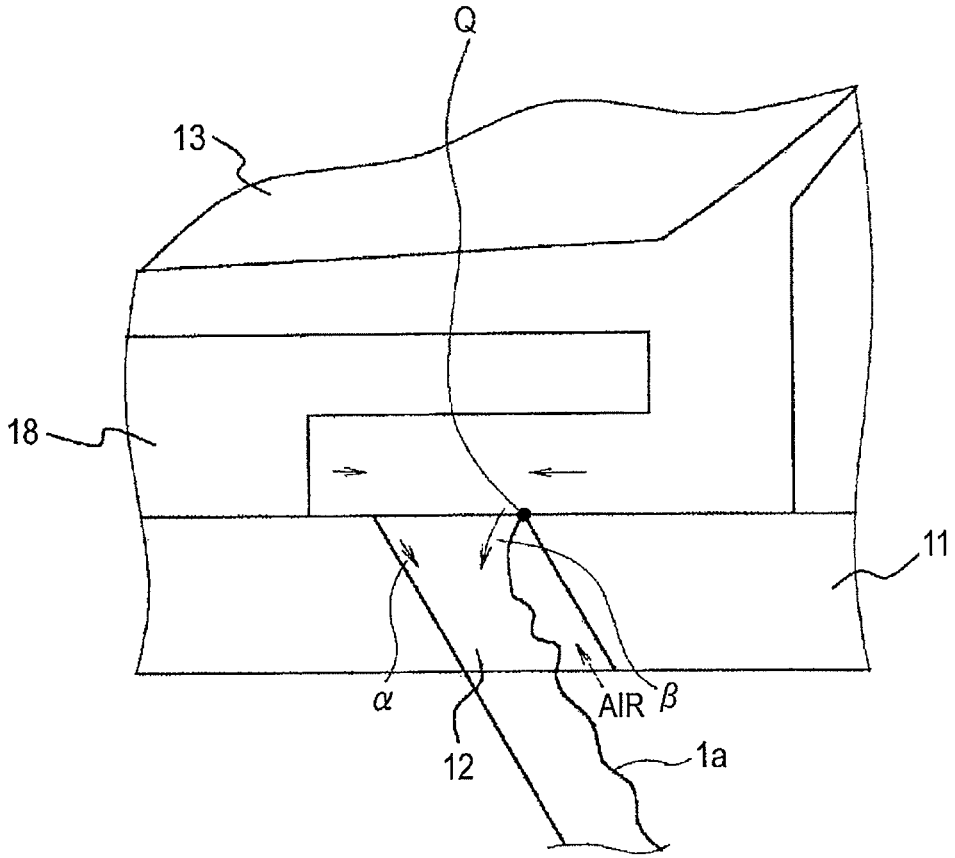
FIG. 5 is an enlarged view showing the injection port portion in FIG. 2.

In the cross section of the injection port shown in FIG. 5, the directions of the fuel flow and the air flow are indicated by arrows.

At the injection port inlet, the slow back-flow forms a flow $\alpha$ that flows along the injection port inner surface, while the fast front face flow forms a flow $\beta$ that presses the fuel.

The air is introduced from the injection port outlet into the vicinity of the injection port inlet, and the air acts on the fuel flow $\beta$ to cause the detachment of the fuel flow originating from a point Q.

As the fuel flow advances in the injection port, the fuel flow is pressed, and the liquid film changes its direction into a direction along the injection port inner surface while spreading in the circumferential direction of the injection port inner surface.

When the injection port length L is appropriate with respect to the radial passage height h, the fuel flow is pressed to the state of a thin liquid film flow in the injection port.

Then, an injected fuel liquid film flow 1*a* travels a predetermined distance and starts to split, and it undergoes a liquid thread state or the like, whereby atomized liquid drops are generated.

In order to make the liquid drops smaller in the atomization process, it is effective to make thinner the liquid thread, which is the previous stage of their splitting. In order to make thinner the liquid thread, it is effective to make thinner the liquid film or the liquid column, which are the previous stage of the splitting of the liquid thread. Also, it has been conventionally known that the liquid film is more advantageous.

Accordingly, in addition to this, various techniques for forming a liquid film flow have been proposed, including the technique of forming a liquid film flow in the injection port by providing a swirl flow for the fuel flow before flowing into the injection port.

The inventors have studied and investigated these techniques of forming the liquid film flow and the atomization processes and the relationship of these techniques with the spray shape, the spray pattern, and the results of the injection amount distribution of the entire spray formed by plural sprays based on these techniques. As a result, on the contrary to the conventional knowledge that "in order to obtain fine atomization, the spread of the spray should have a wider angle in order to avoid collision and integration of spray particles," the inventors have found the fact to which the just-mentioned knowledge does not necessarily applies, that is, a technique by which the atomization does not degrade even when the angle of the spray is made narrower, and thus, the inventors have achieved a compact atomized spray.

Although various atomization techniques such as described above have been applied to the fuel injection valve, the current technical trend has originally been to make the injection port diameter smaller and increase the number of the orifices for atomization. Accordingly, care has been taken so that the jet flows from the adjacent orifices do not interfere with each other and the atomization state does not degrade.

In other words, because the injection port arrangement and the injection port specifications, or the jet flow arrangement and the jet flow direction, are employed such that the injection port central axes or the jet flow directions are more and more separated as they are in farther downstream positions, it has been difficult to achieve both the requirements of atomization and compact spray.

Here, in the port injection system, the adherence of fuel to the intake port has no favorable influence or effect at all, so the prevention thereof is a top priority issue.

Therefore, even when the atomization has been improved in order to reduce the rate of the spray adhering to the intake valve or the intake port near the intake valve, it has been difficult to obtain an advantage as the port injection system since the entire spray spreads and as a result the spray side face adheres to a different portion of the intake port.

On the other hand, one in which the spread of the entire spray is inhibited employs the injection port arrangement and the injection port specifications, or the jet flow arrangement and the jet flow directions, such that the injection port central axes or the jet flow directions intersect each other at immediately downstream from the orifices. It does not take into consideration the requirements of atomization, such as the relationship with the break-up length.

In addition, the angle of the injection port central axis is relatively small, which is disadvantageous for forming a thin liquid film flow. As a consequence, the atomization process becomes slow and the interference between the jet flows tends to occur. Therefore, the atomization level cannot be realized to match an expected value.

Here, the inventors have focused attention on the difference between the behavior of a single spray alone and the behavior of a single spray among plural sprays and as a result have found a new phenomenon originating from an atomized spray.

That is, the following way of determining the injection port arrangement and the injection port specifications is employed. The position and shape of the entire spray as well as the injection amount distribution are not determined by three-dimensionally studying the injection port arrangement and the injection port specifications from the injection port central axes or the jet flow directions, but the injection port arrangement and the injection port specifications are contemplated such as to identify the characteristics of the behavior of the entire spray and to control the characteristics.

Figure 6A:
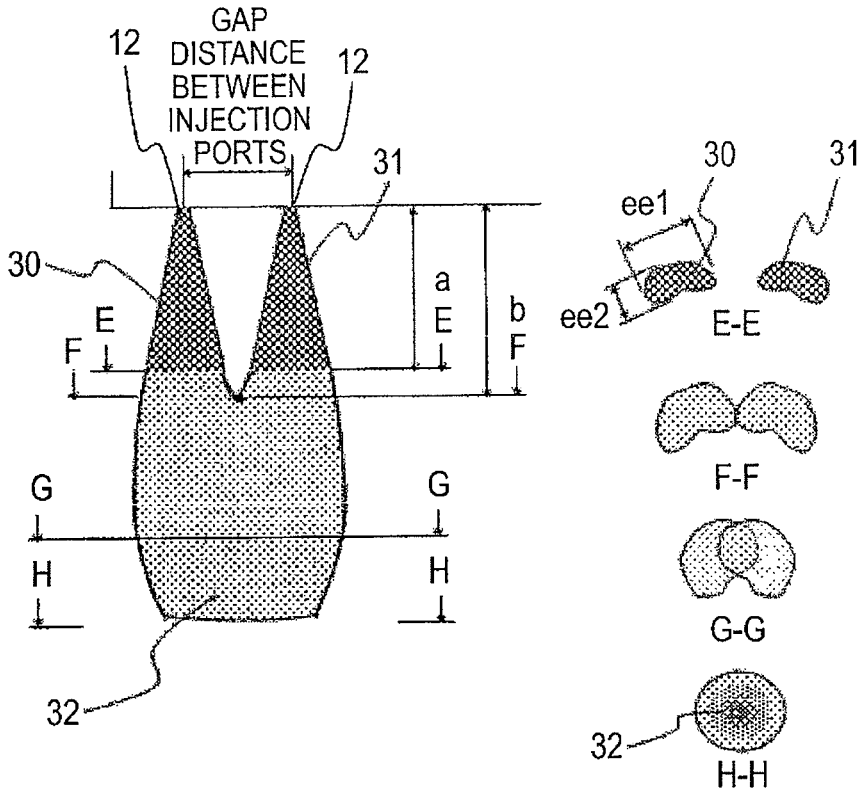
FIGS. 6A to 6C show illustrative views showing basic shapes of how sprays converge in the first and second preferred embodiments.

FIG. 6A shows the details of the basic behavior of such an embodiment.

Jet flows 30, 31 from adjacent orifices 12, 12 are arranged so as to have a cross section E-E at the break-up length position. Where this break-up length is a, the contours of the two sprays 30, 31 start to come into contact with each other (cross section F-F) at the position with a distance b from the orifices 12, 12, at which the jet flows are dispersed and turned into sprays. At the same time, because of the Coanda effect working between the two sprays, the sprays moves closer to each other from the cross section F-F, in which the two sprays tend to face each other due to the pressure distribution, and then the sprays approach and converge with each other in such a way from a cross section G-G and then to a cross section H-H. When the two sprays converge with each other until the Coanda effect is almost lost, they become one spray 32.

The standard specifications of the orifices 12 that can achieve a necessary and sufficient atomization level may be determined because the success or failure of the liquid film flow formation and the level thereof are determined mainly from the injection port's shape, size, arrangement, direction, injection port angle, and injection port L/D (injection port length/injection port diameter).

Next, the break-up length a for each jet flow can be estimated by, for example, simulation, and therefore, mainly the shape, size, arrangement, direction, injection port angle, injection port L/D, and the like of each of the orifices 12, or the shape, size, arrangement, direction, speed, and the like of each of the jet flows, are adjusted in such a manner that the adjacent sprays is influenced by the Coanda effect at a downstream position from the break-up length and converge with each other.

From the results of the studies carried out by the inventors, it was found that it is suitable for the spray convergence to cause the spray contours to start to interfere with each other in the range from the position of the break-up length a to position b up to about two times the break-up length (i.e., $b \leq 2a$), with each of the orifices 12 being the reference point.

Here, when the atomization is performed with smaller particles, the number of the spray particles is greater, so the number of the air swirls produced around the spray particles is greater. This causes the static pressure of the spray atmosphere to decrease due to the energy of the swirls. However, because there are many locations at which the static pressure decreases, the Coanda effect tends to work uniformly. Moreover, since the spray particle is small, the spray particle is more easily affected by the Coanda effect.

As a result, the convergence (integration) of each of the sprays proceeds, and the convergence of the sprays is continued until the Coanda effect is substantially lost finally. Thus, a compact atomized spray can be achieved.

In the case of the port injection, the density of the spray particles downstream from the break-up length is extremely lower than the cases of the gasoline in-cylinder injection spray and the diesel spray (at the levels of about 1/10 or lower of the gasoline in-cylinder injection spray and about 1/100 or lower of the diesel spray), and the particles basically travel at almost the same speed in the same direction. Therefore, it may be understood that there is almost no collision and integration of the particles with each other.

In addition, it may be understood that the splitting from a single particle does not occur at a fuel pressure level of 0.3 Mpa in the case of the port injection.

Here, in order to produce the above-described spray behavior, it is possible to vary, for example, the shapes, dimensions, arrangements, directions, injection port angles, and injection port L/Ds of each of the orifices 12 as well as the shapes of the nozzles upstream from the orifice plate, or the shapes, dimensions, arrangements, directions, and speeds of each of the jet flows.

Figure 6B:
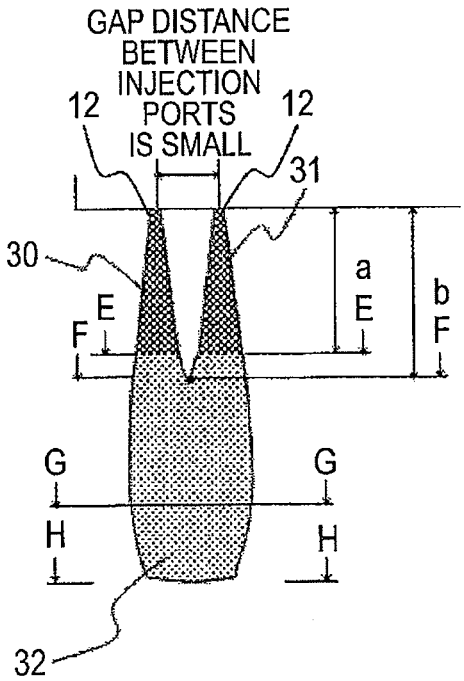
Figure 6C:
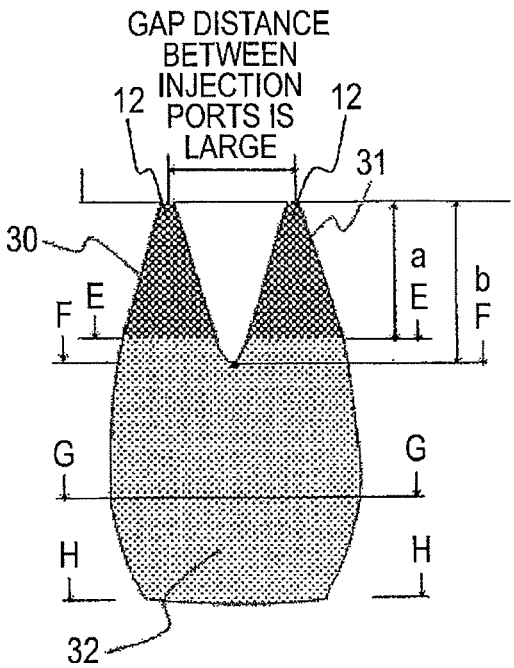

For example, when a more compact converged spray is required, the gap distance between the sprays may be made smaller as shown in FIG. 6B corresponding to the smaller spray angle. On the contrast, when a slightly wider converged spray is required, the gap distance between the sprays may be made wider as shown in FIG. 6C corresponding to the wider spray angle.

As described above, the first preferred embodiment of the invention provides the following method of generating a spray by a fluid injection valve. The fluid injection valve includes a valve seat 10 having a valve seat face 10*a* in a midpoint of a fluid passage, a valve body 8 for controlling opening/closing of the fluid passage by seating/unseating to the valve seat face, and an orifice plate 11 located downstream from the valve seat and having plural orifices 12. The fluid injection valve is configured to make flows in each of the orifices and flows directly below each of the orifices substantially liquid film flows. The method of generating a spray by a fluid injection valve includes: not necessarily matching directions of jet flows 30, 31 from each of the orifices 12, 12 to the central axis directions of the orifices and not necessarily intersecting the jet flows with each other at a downstream position thereof; after the jet flows from each of the orifices 12 become sprays at a downstream position farther than a break-up length a, causing the sprays to converge by the Coanda effect acting on plural sprays; and allowing the convergence of the sprays to continue until the Coanda effect is substantially lost. This makes it possible to achieve both an improvement in atomization of fuel spray and an improvement in freedom in designing the spray shape, the spray pattern, and the injection amount distribution.

Second Preferred Embodiment

The second preferred embodiment of the invention will be described with reference to FIG. 6A.

In this embodiment, the aspect ratio (ee1/ee2) of the substantially ellipsoidal shape or the substantially crescent shape, which are the cross-sectional shape of the jet flows directly below each of the orifices, is set relatively greater with respect to 1 (preferably 1.5 or larger), as shown in the cross section E-E in FIG. 6A.

Thereby, the area in which the sprays face each other increases, allowing the Coanda effect resulting from the pressure distribution to work more strongly, and the convergence thereof proceeds. Thus, a more compact atomized spray can be obtained.

Third Preferred Embodiment

The third preferred embodiment of the invention will be described with reference to FIGS. 7A to 7D.

FIG. A is a plan view showing an example of the arrangement of the orifices in a two-spray system, viewed along the central axis of the fuel injection valve 1 from the upstream side thereof. The orifices 12*b* to 12*f* correspond to one-side spray of the two sprays respectively, and the specifications thereof may be different from each other.

Figure 7A:
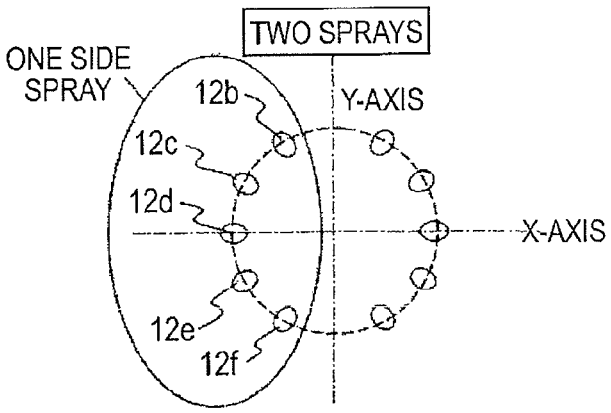
FIGS. 7A to 7D show illustrative views showing how sprays converge according to a third preferred embodiment.
Figure 7B:
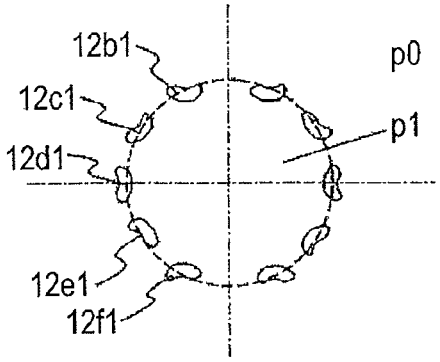

FIG. 7B shows an example of the jet flow arrangement and the jet flow shape directly below the orifices in the example of the injection port arrangement of FIG. 7A. The jet flows 12*b*1 to 12*f*1 adjacent to each other are in a proximity condition to each other.

Figure 7C:
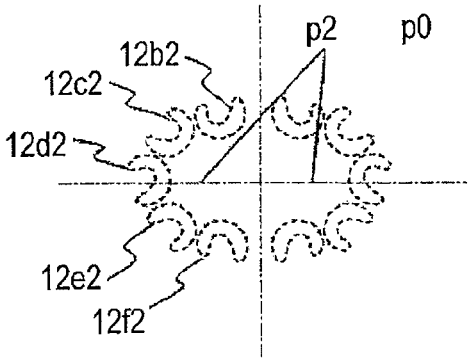

FIG. 7C shows an example of the spray arrangement and the spray shape downstream from the break-up length. It shows a state in which each of the sprays 12*b*2 to 12*f*2 simultaneously gather like a circle because the sprays 12*b*2 to 12*f*2 are connected to each other in a circumferential direction.

Figure 7D:
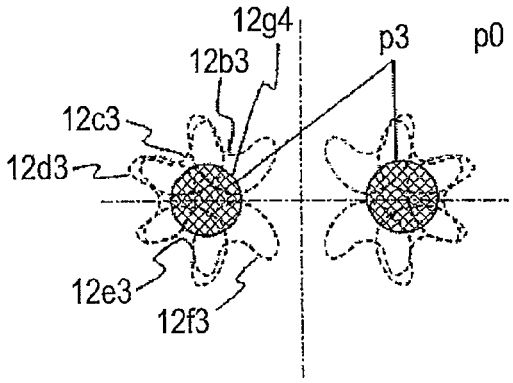

FIG. 7D shows an example of the arrangement and the spray shape of the sprays 12*b*3 to 12*f*3 at a location where the Coanda effect works, and an example of the spray arrangement and the spray shape at a location where the Coanda effect is lost. It shows a state in which each of the one-side sprays of the two sprays is formed in a solid and compact manner.

In this third preferred embodiment, the jet flows 12*b*1 to 12*f*1, each of which has a cross-sectional shape, for example, in a substantially ellipsoidal shape or in a substantially crescent shape directly below each of the orifices, are configured to be sprays 12*b*3 to 12*f*3 having a polygonal cross-sectional shape at a position downstream from the break-up length.

The sprays 12*b*3 to 12*f*3 having a polygonal cross-sectional shape are formed by connecting extension lines of the major axes of the substantially ellipsoidal shapes or the curved portion tangent lines of the substantially crescent shapes, which are the spray cross-sectional shapes, to form the sides of the substantially polygonal shape, or by allowing the tip portions of the substantially ellipsoidal shapes or the substantially crescent shapes to be the vertexes of substantially polygonal shape.

Thus, when the sprays 12*b*3 to 12*f*3 having a polygonal cross-sectional shape is formed at a position downstream from the break-up length, the pressure difference between the inside and outside of the polygonal cross-sectional shape arises easily (the internal pressures p1, p2, and p3 become lower than the external pressure p0) because of the entrainment of the internal air by the jet flows and the spray flows. This allows the Coanda effect to work more strongly, and the convergence thereof advances. Thus, a more compact atomized spray 12*g*4 can be realized.

It should be noted that the behaviors of the jet flows and the spray flows from the adjacent orifices are the same as those depicted in FIG. 6. In addition, the two sprays may not necessarily be symmetrical with respect to the X-axis or the Y-axis.

Fourth Preferred Embodiment

The fourth preferred embodiment of the invention will be described with reference to FIGS. 8A and 8B.

Figure 8A:
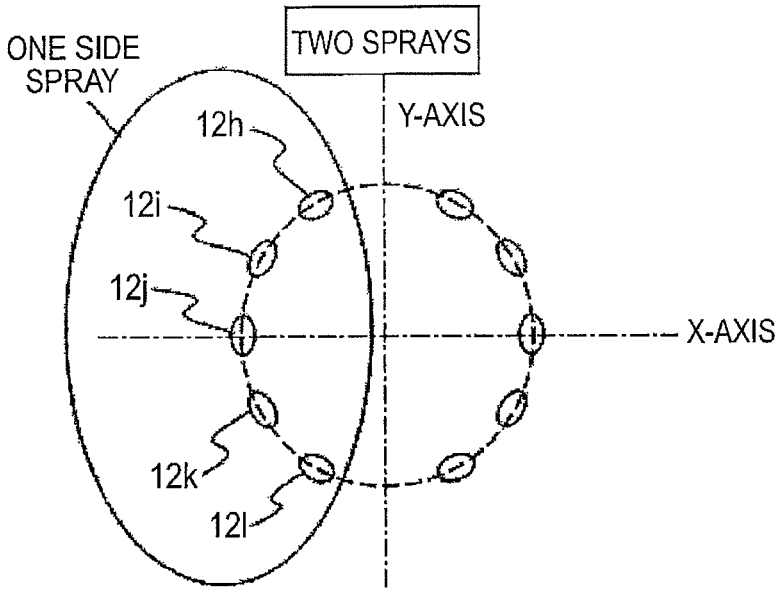
FIGS. 8A and 8B show illustrative views showing how sprays converge according to a fourth preferred embodiment.

FIG. 8A is a plan view showing an example of the arrangement of the orifices in a two-spray system, viewed along the central axis of the fuel injection valve 1 from the upstream side thereof. The orifices 12*h* to 12*l* correspond to one-side spray of the two sprays respectively, and the specifications thereof may be different from each other.

Figure 8B:
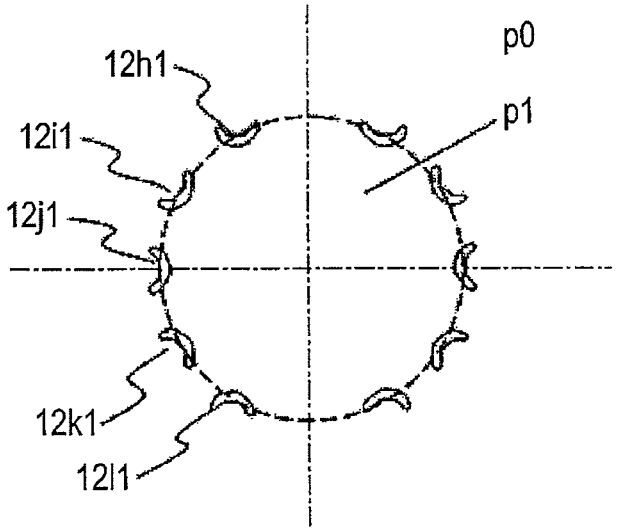

FIG. 8B shows an example of the jet flow arrangement and the jet flow shape directly below the orifices in the example of the injection port arrangement of FIG. 8A. The aspect ratio of the cross-sectional shape of each of the jet flows 12*h*1 to 12*l*1 directly below the orifices is set to greater than 1.5.

In this fourth preferred embodiment, the aspect ratio of each of the jet flow shapes 12*h*1 to 12*l*1 directly below the injection port is made greater, so that the internal pressure p1 can be made even lower than the external pressure p0. Therefore, the convergence proceeds because the Coanda effect becomes to work more strongly. Thus, a more compact atomized spray can be obtained.

It should be noted that the behaviors of the jet flows and the spray flows from the adjacent orifices are the same as those depicted in FIG. 6. In addition, the two sprays may not necessarily be symmetrical with respect to the X-axis or the Y-axis.

Fifth Preferred Embodiment

The fifth preferred embodiment of the invention will be described with reference to FIGS. 9A to 9D.

Figure 9A:
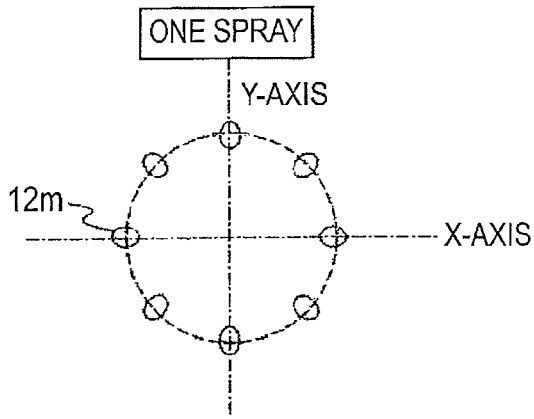
FIGS. 9A to 9D show illustrative views showing how sprays converge according to a fifth preferred embodiment.

FIG. 9A is a plan view showing an example of the arrangement of the orifices 12*m* in a one-spray system, viewed along the central axis of the fuel injection valve 1 from the upstream side thereof.

Figure 9B:
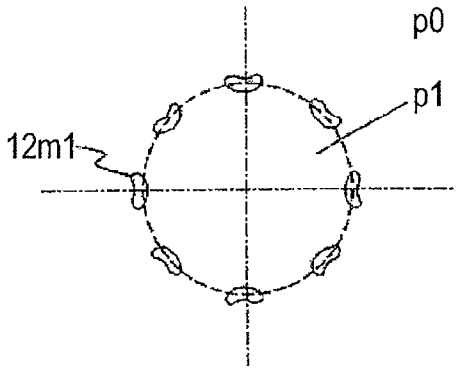

FIG. 9B shows an example of the jet flow arrangement and the jet flow shape directly below the orifices in the example of the injection port arrangement of FIG. 9A. The jet flows 12*m*1 adjacent to each other are in a proximity condition to each other.

Figure 9C:
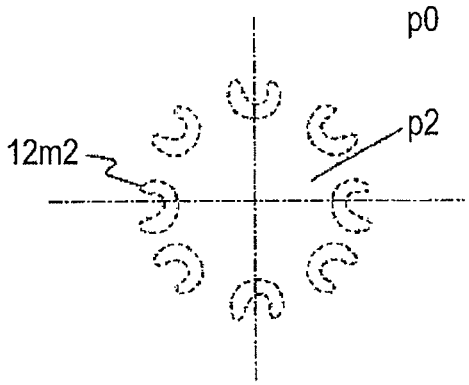

FIG. 9C shows an example of the spray arrangement and the spray shape downstream from the break-up length. It shows a state in which the sprays 12*m*2 are also brought closer to the Z axis simultaneously because the sprays 12*m*2 are connected to each other in a circumferential direction.

Figure 9D:
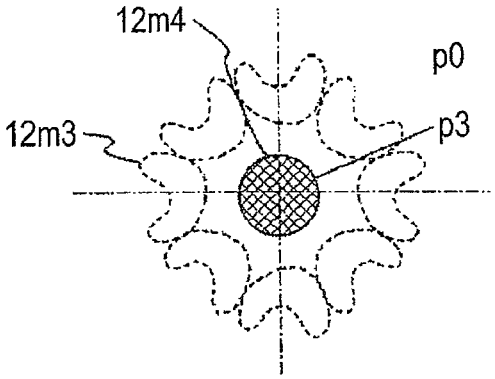

FIG. 9D shows an example of the spray arrangement and the spray shape at a location where the Coanda effect works, and an example of the spray arrangement and the spray shape at a location where the Coanda effect is lost. It shows a state in which a solid and compact spray 12*m*4 is formed by the sprays 12*m*3 obtained at the location where the Coanda effect works.

In this fifth preferred embodiment, each of the orifices 12*m* is provided radially. The jet flows 12*m*1 directly below each of the orifices have a cross-sectional shape in a substantially ellipsoidal shape or in a substantially crescent shape, and the major axis components thereof or the curved portion tangent line components thereof are disposed at a substantially equal gap along a substantially circumferential direction.

Thereby, the Coanda effect works substantially uniformly over the circumferential direction. Because of the difference between the external pressure p0 and the internal pressures p1, p2, and p3, the jet flows 12*m*1 directly below the orifices likewise undergo the cross-sectional shapes of the sprays 12*m*2 and 12*m*3 to proceed the convergence. Thus, a more compact atomized spray 12*m*4 in a one spray system can be obtained.

It should be noted that the behaviors of the jet flows and the spray flows from the adjacent orifices are the same as those depicted in FIG. 6. In addition, the jet flow arrangement may not necessarily be symmetrical with respect to the X-axis or the Y-axis.

Sixth Preferred Embodiment

The sixth preferred embodiment of the invention will be described with reference to FIGS. 10A to 10D.

Figure 10A:
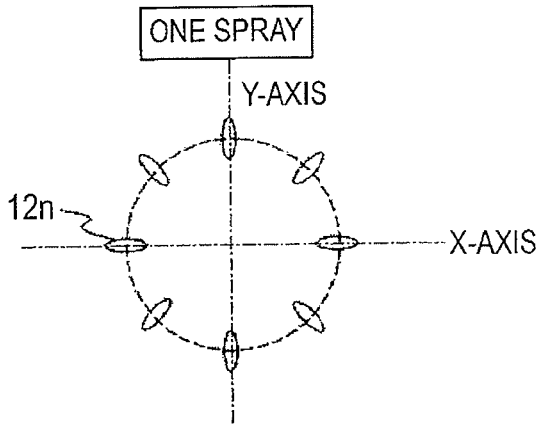
FIGS. 10A to 10D show illustrative views showing how sprays converge according to a sixth preferred embodiment.

FIG. 10A is a plan view showing an example of the arrangement of the orifices 12*n* in a one-spray system, viewed along the central axis of the fuel injection valve 1 from the upstream side thereof.

Figure 10B:
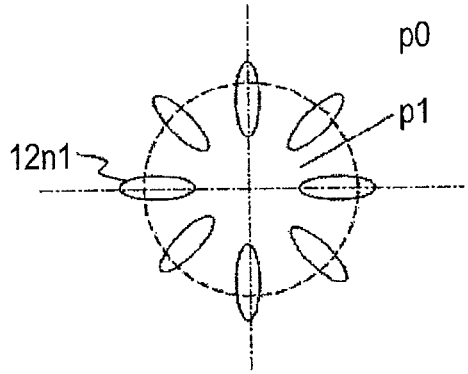

FIG. 10B shows an example of the jet flow arrangement and the jet flow shape directly below the orifices in the example of the injection port arrangement shown in FIG. 10A.

Figure 10C:
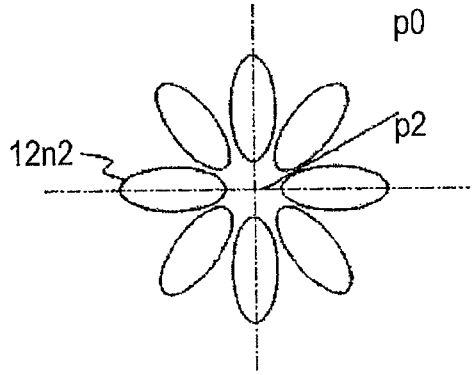

FIG. 10C shows an example of the jet flow arrangement and the jet flow shape downstream from the break-up length.

Figure 10D:
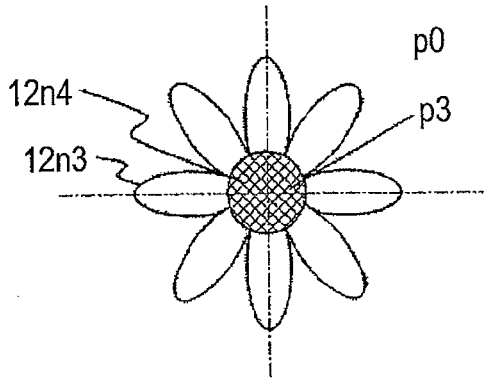

FIG. 10D shows an example of the spray arrangement and the spray shape at a location where the Coanda effect works, and an example of the spray arrangement and the spray shape at a location where the Coanda effect is lost.

In this sixth preferred embodiment, each of the orifices 12*n* is provided radially. The jet flows 12*n*1 directly below each of the orifices have a cross-sectional shape in a substantially ellipsoidal shape or in a substantially crescent shape, and the major axis components thereof or the curved portion tangent line components thereof are formed so as to be in a substantially radial shape or in a substantially windmill shape.

Thereby, the opposing faces of adjacent sprays 12*n*2 are closer to each other at locations nearer to the center of the entire spray, so that the Coanda effect works stronger because of the different between the external pressure p0 and the internal pressures p1, p2, and p3.

In addition, this causes all the sprays to be pulled toward the center, so the convergence proceeds through the cross-sectional shapes such as the sprays 12*n*2 and the sprays 12*n*3. Thus, a more compact atomized spray 12*n*4 of a one-spray system can be obtained.

It should be noted that the behaviors of the jet flows and the spray flows from the adjacent orifices are the same as those depicted in FIG. 6. In addition, the jet flow arrangement may not necessarily be symmetrical with respect to the X-axis or the Y-axis.

In addition, by designing the orifice plate and the components upstream therefrom in such a manner as to give a swirl to the fuel flow flowing into each of the orifices 12*n* and form a liquid film in the injection port, the major axis components of the substantially crescent-shaped jet flow cross sections at directly below the orifices can be turned into a substantially windmill shape.

Seventh Preferred Embodiment

The seventh preferred embodiment of the invention will be described with reference to FIG. 11.

Figure 11:
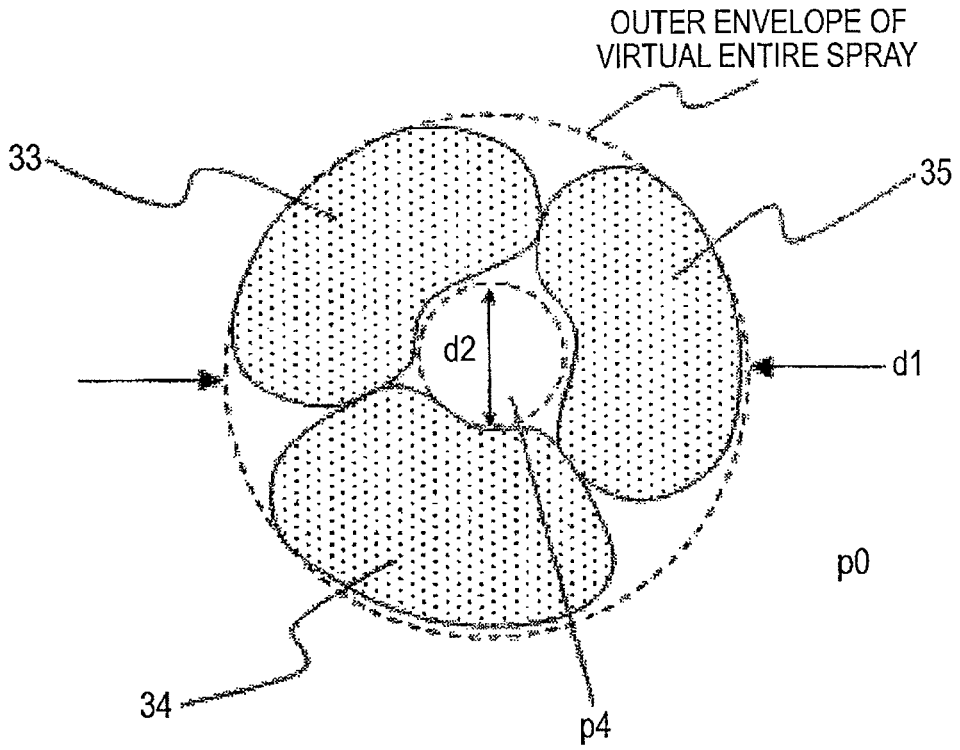
FIG. 11 is an illustrative view showing how sprays converge according to a seventh preferred embodiment.

FIG. 11 is an illustrative view showing how sprays converge according to the seventh preferred embodiment. The cross-sectional shape of each of proximate sprays 33, 34, and 35 is in a substantially circular shape or in a substantially elliptical shape.

At a location where the difference between the external pressure p0 of these sprays and the internal pressure p4 becomes small and the Coanda effect is almost lost, the injection amount distribution in the cross section of the converged spray shows a substantially conical distribution having a peak substantially in the vicinity of the center. The spread of the converged spray lies inside the outer envelope of the virtual entire spray formed by connecting virtual single spray contours that are estimated from the directions or the outermost peripheral portions of the substantially ellipsoidal shapes or the substantially crescent shapes that are the cross-sectional shapes of each of the jet flows.

Thereby, the converged spray is in a very stable state, so it becomes possible to obtain a compact atomized spray that shows a stable behavior even with disturbance factors such as changes in the atmospheric conditions.

It should be noted that the behaviors of the jet flows and the spray flows from the adjacent orifices are the same as those depicted in FIG. 6.

Here, as a result of assiduous studies conducted by the inventors, it was found that it is suitable for the convergence of the sprays that approximately d2≤½d1, where d1 and d2 are diameters of respective circular shapes corresponding to an outer envelope and an inner envelope of spray contours as viewed in a cross-section perpendicular to a spray direction at a position where the spray contours start to interfere with each other, when each of the outer envelope and the inner envelope are assumed to be substantially circular.

Eighth Preferred Embodiment

The eighth preferred embodiment of the invention will be described with reference to FIGS. 12A to 12D.

Figure 12A:
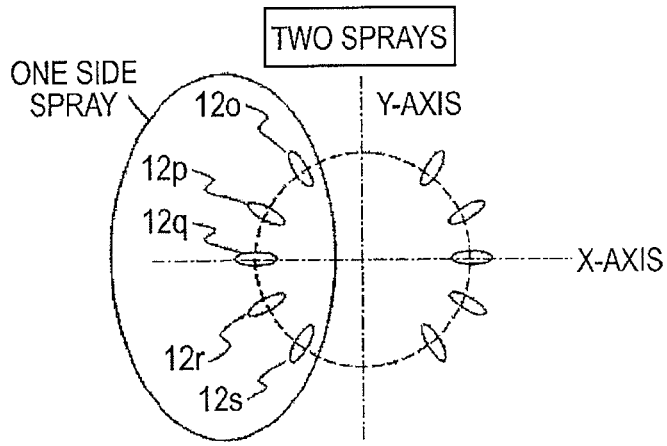
FIGS. 12A to 12D show illustrative views showing how sprays converge according to an eighth preferred embodiment.

FIG. 12A is a plan view showing an example of the arrangement of the orifices in a two-spray system, viewed along the central axis of the fuel injection valve 1 from the upstream side thereof. The orifices 12*o* to 12*s* correspond to one-side spray of the two sprays respectively, and the specifications thereof may be different from each other.

Figure 12B:
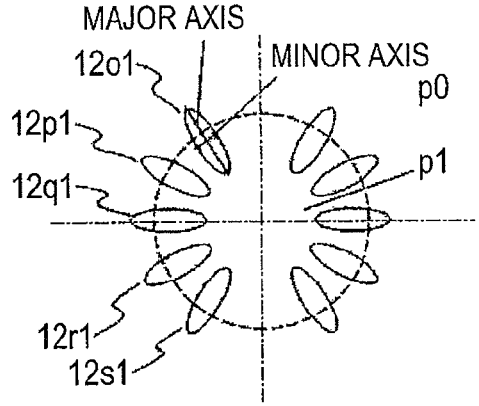

FIG. 12B shows an example of the jet flow arrangement and the jet flow shape directly below the orifices in the example of the injection port arrangement shown in FIG. 12A.

Figure 12C:
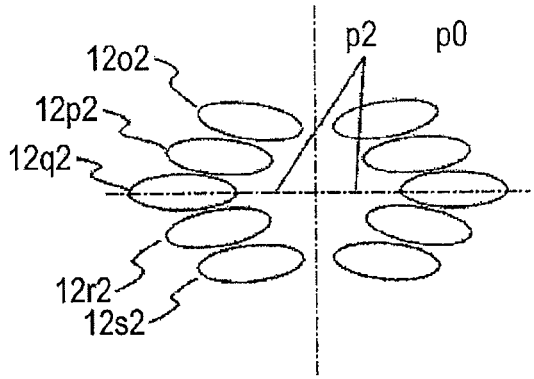

FIG. 12C shows an example of the spray arrangement and the spray shape downstream from the break-up length.

Figure 12D:
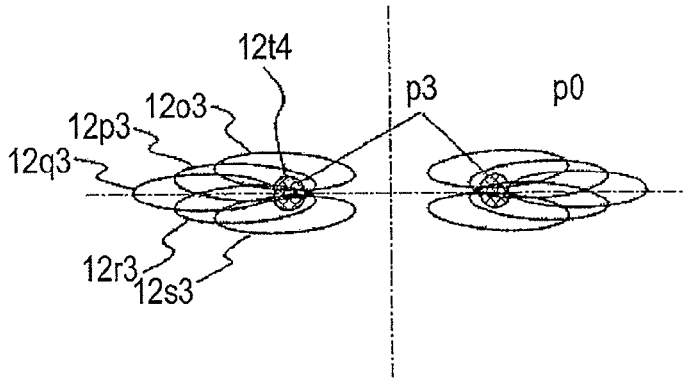

FIG. 12D shows an example of the spray arrangement and the spray shape at a location where the Coanda effect works, and an example of the spray arrangement and the spray shape at a location where the Coanda effect is lost.

In this eighth preferred embodiment, the orifices 12*o*1 to 12*s*1 have a cross-sectional shape in a substantially ellipsoidal shape or in a substantially crescent shape, for example, and the difference between the external pressure and the internal pressure is set so that the major axis components thereof or the curved portion tangent line components thereof are brought proximate to each other to converge in a substantially linear shape or in a substantially curved shape.

Thereby, the minor axis components of the sprays 12*o*2 to 12*s*2 can be gathered in the Y-axis direction near the X-axis by the Coanda effect, and the convergence proceeds from the sprays 12*o*2 to 12*s*2 to the sprays 12*o*3 to 12*s*3. Thus, it becomes possible to obtain a more compact atomized spray 12*t*4.

It should be noted that the behaviors of the jet flows and the spray flows from the adjacent orifices are the same as those depicted in FIG. 6. The main purpose of this preferred embodiment is that the sprays are converged in a substantially ellipsoidal shape or in a substantially crescent shape, so the sprays need not be along the X-axis direction. In addition, in the case of two sprays, the two sprays need not be symmetrical with each other with respect to the Y-axis.

Ninth Preferred Embodiment

The ninth preferred embodiment of the invention will be described with reference to FIG. 13.

Figure 13:
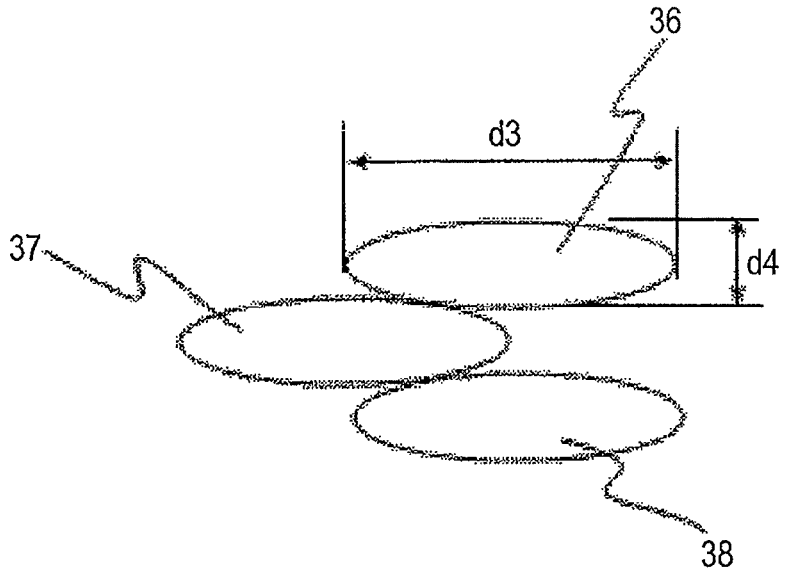
FIG. 13 is an illustrative view showing how sprays converge according to a ninth preferred embodiment.

FIG. 13 is an illustrative view showing how sprays converge according to the seventh preferred embodiment. The cross-sectional shape of each of proximate sprays 36, 37, and 38 is in a substantially ellipsoidal shape. Ata location where the difference between the external pressure and the proximate portion pressure of these sprays becomes small and the Coanda effect is almost lost, the injection amount distribution of the cross section of the converged spray is a substantially ellipsoidal distribution. The spread of the converged spray along its minor axis is shorter than the minor axis length of the virtual entire spray formed by connecting virtual single spray contours estimated from the directions of the jet flows in a substantially ellipsoidal shape or in a substantially crescent shape.

Thereby, the converged spray is in a very stable state, so it becomes possible to obtain a compact atomized spray that shows a stable behavior even with disturbance factors such as changes in the atmospheric conditions.

It should be noted that the behaviors of the jet flows and the spray flows from the adjacent orifices are the same as those depicted in FIG. 6. The main purpose of this preferred embodiment is that the sprays are converged in a substantially ellipsoidal shape or in a substantially crescent shape, so the sprays need not be along the X-axis direction. In addition, in the case of two sprays, the two sprays need not be symmetrical with each other with respect to the Y-axis.

Here, as a result of assiduous studies conducted by the inventors, it was found that it is suitable for the convergence of the sprays that approximately d4≤½d3, where d3 and d4 are, respectively, a major axis length and a minor axis length of an envelope of each of spray contours as viewed in a cross-section perpendicular to a spray direction at a position where the spray contours start to interfere with each other, each of the envelope being assumed to be in a substantially ellipsoidal shape or in a substantially crescent shape.

Tenth Preferred Embodiment

Figure 14:
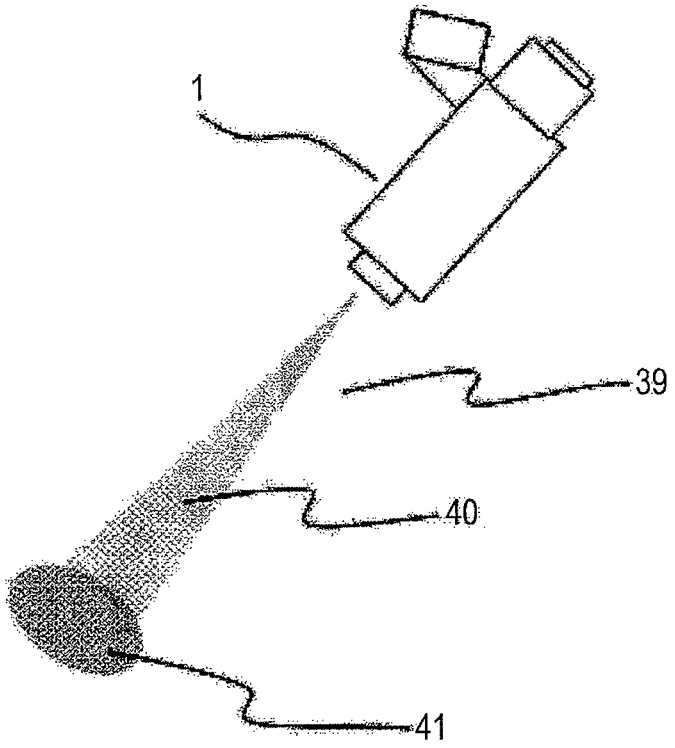
FIG. 14 is an illustrative view showing a spray according to a tenth preferred embodiment.

The tenth preferred embodiment of the invention will be described with reference to FIG. 14.

The Coanda effect almost loses its effect on a converged spray 39 generated by the fuel injection valve 1 when the pressure difference attracting the spray particles is substantially lost. For this reason, a spray 40 within the range in which the Coanda effect works is suddenly turned into a spray 41 having a reduced penetration distance. As a result, it becomes possible to obtain a compact atomized spray having a spray penetration distance specification corresponding to a predetermined length.

Here, as described above, the smaller the particles are atomized, the more the convergence of plural sprays can proceed. However, once the Coanda effect loses its effect, the momentum of the particles suddenly drops. Therefore, it becomes possible to form a spray having a penetration distance that is suddenly reduced.

Moreover, since the spray 41 has lost the energy for acting against the intake air flow movement, it becomes possible to obtain a compact atomized spray that can follow the intake air flow movement. In other words, the adhesion of the sprays to the intake port wall surface and the intake valve is minimized immediately before the intake valve, irrespective of the injection timing. As a result, it becomes possible to obtain an atomized spray that can follow the intake air flow movement in the intake port according to the intake port shape.

Eleventh Preferred Embodiment

The eleventh preferred embodiment of the invention will be described with reference to FIGS. 7A to 7D, 9A to 9D, and 15A to 15C.

Figure 15A:
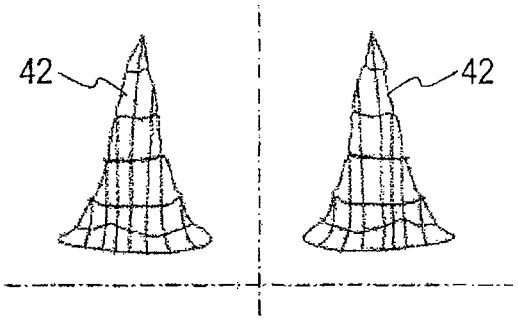
FIGS. 15A to 15C show illustrative views showing a spray system according to an eleventh preferred embodiment.

FIG. 15A shows an example of the injection amount distribution of the two sprays shown in FIG. 7.

Figure 15B:
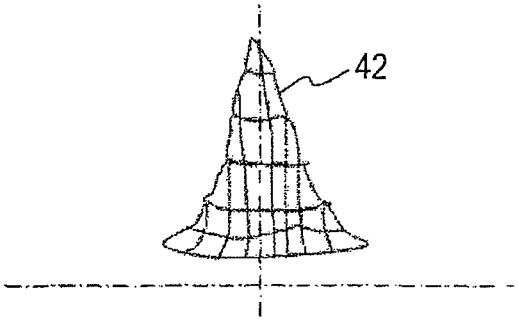

FIG. 15B shows an example of the injection amount distribution of the one spray shown in FIG. 9.

Figure 15C:
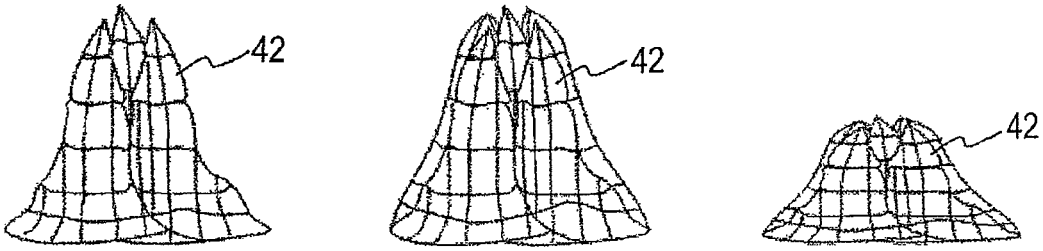

FIG. 15C shows an example of the injection amount distribution of the eleventh preferred embodiment.

In this eleventh preferred embodiment, in the convergence phenomenon of plural sprays 42, plural portions are provided with almost no pressure difference between the internal pressure p3 and the external pressure p0 of the entire converged spray, as shown in FIG. 15C.

Thereby, at these portions, the force attracting the spray particles is substantially lost. Consequently, the sprays converge with each other and show stable behaviors. As a result, it becomes possible to obtain a compact atomized spray that enables the injection amount distribution of the converged spray to be set freely without controlling the peak of the injection amount distribution of the converged spray to be almost at the center of the spray shape.

This is also applicable to the other embodiments.

Twelfth Preferred Embodiment

Figure 16:
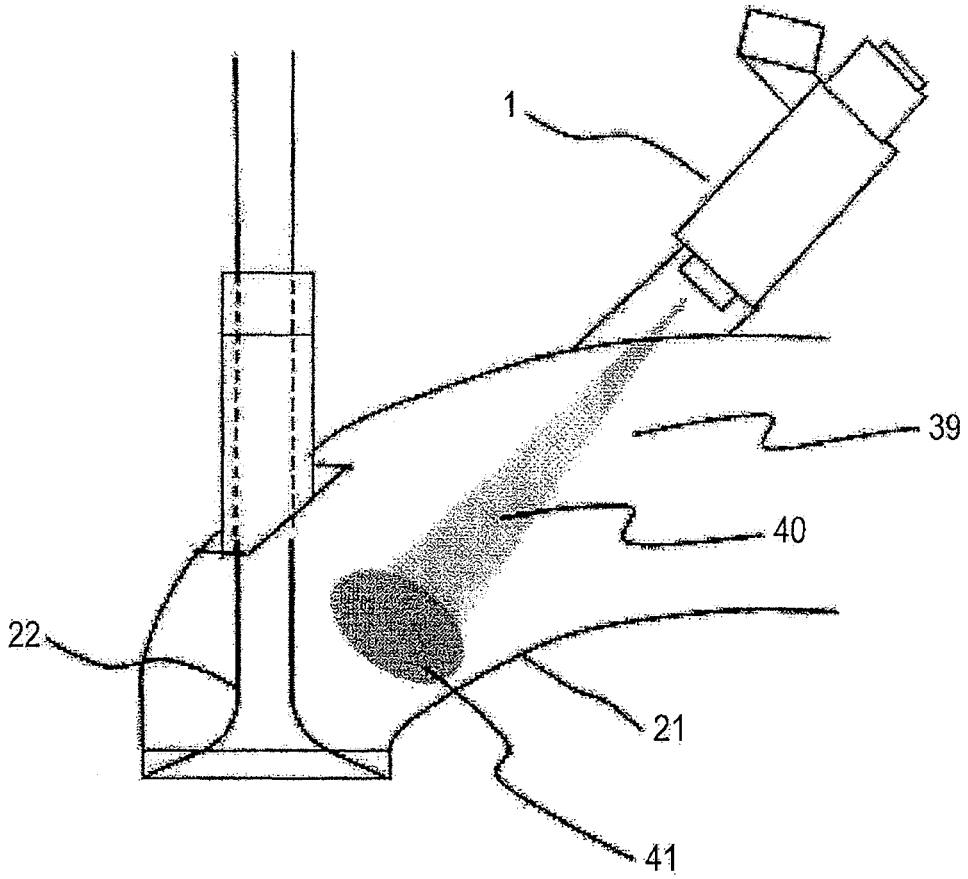
FIG. 16 is an illustrative view showing a spray system according to a twelfth preferred embodiment.

The twelfth preferred embodiment of the invention will be described with reference to FIG. 16. The figure shows only one cylinder in a multi-cylinder engine.

In this twelfth preferred embodiment, the spray direction length at which the Coanda effect is substantially lost, or the spray direction length at which the spray suddenly starts to reduce the penetration distance, is configured to be adjustable according to a length from the injection point to the intake valve 22 or a length from the injection point to the intake port wall surface facing the spray tip-end portion 41 in the case of a port injection system.

Thereby, in an intake port injection system of an actual engine, adhesion of the sprays to the intake port wall surface and the intake valve can be inhibited according to the shapes and dimensions of each of the intake ports. Moreover, it becomes possible to obtain a compact atomized spray 39 with spray specifications such that the spray can easily follow the intake air flow movement.

Thirteenth Preferred Embodiment

Figure 17:
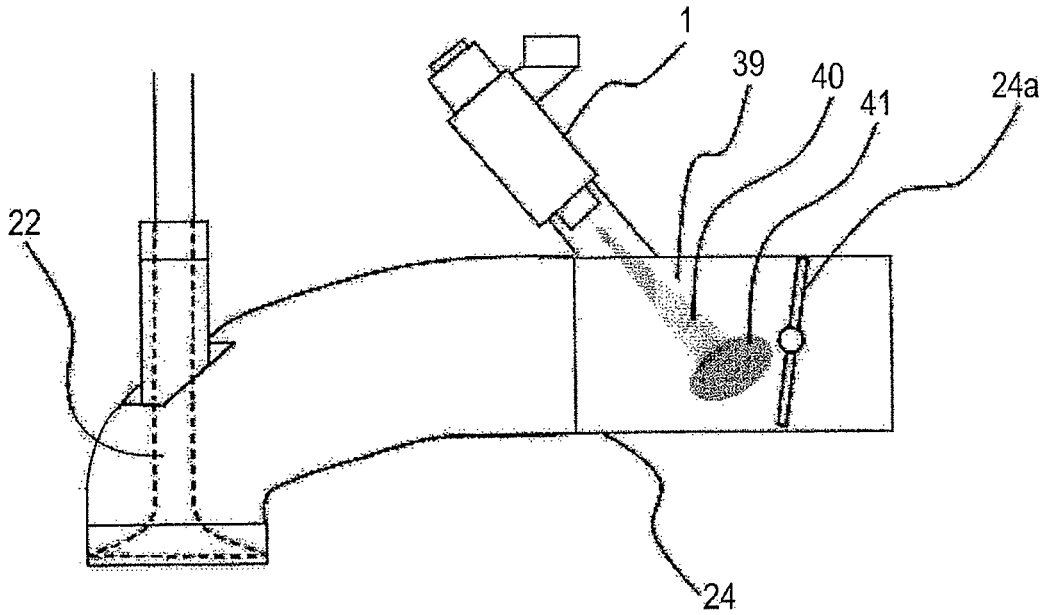
FIG. 17 is an illustrative view showing a spray system according to a thirteenth preferred embodiment.

The thirteenth preferred embodiment of the invention will be described with reference to FIG. 17.

The figure shows only one cylinder in a multi-cylinder engine. The fluid injection valve 1 is mounted to a throttle body 24, and the tip portion thereof is fitted at a downstream-side position of a throttle valve 24*a* of the throttle body 24 so as to be inclined toward an upstream side so that fuel can be injected toward the upstream of the intake air flow.

This thirteenth preferred embodiment makes it possible to suddenly reduce the penetration distance of the atomized spray immediately before the throttle body wall face or the throttle valve. As a result, margins in terms of time and space for forming the air-fuel mixture can be provided by temporarily injecting the fuel toward an upstream location. This makes it possible to improve such conditions that, if the fuel is injected in a downstream direction, such as in the case where the intake port is extremely short, the injection amount distribution between the cylinders becomes uneven or the amount of the sprays adhering to the intake port increases, consequently resulting in poor air-fuel mixture formation conditions and preventing the engine performance from getting better.

Furthermore, by utilizing the characteristics of the spray of the invention, it is possible to provide only one fuel injection valve in the intake manifold portion. Thereby, while inhibiting the adhesion of the sprays to the intake ports to the vicinity of the intake valves for the cylinders, it is possible to reduce the penetration distance and carry out a wide angle spraying in the vicinity of the intake valves.

In what are called general-purpose engines and small-sized engines, the carburetor is currently being replaced by the fuel injection system. However, since a considerable increase in the cost is difficult, such a system as described above that uses only one fuel injection valve in a multi-cylinder engine (what is called a single point injection) is very effective in improving the cost/performance ratio of the engine. It should be noted that it is also possible to obtain the above-described advantageous effects even when the fuel injection valve 1 is fitted separately from the throttle body 24.

In the foregoing preferred embodiments, the two spray system and the one spray system have been described regarding the spray pattern. However, as long as the spray is a compact atomized spray, various specifications can be made available, including multi-spray systems such as a three-spray system, combinations of sprays having different cross-sectional shapes, asymmetrical sprays, combinations of sprays having different penetration distances, and combinations of sprays having different atomized sprays.

Although the electromagnetic fuel injection valve has been described herein, the driving source may be other types, and it is clear that the invention is applicable to continuous injection valves, not just to mechanical or sequential injection valves.

Moreover, in addition to the fuel injection valve, the applications and required functions vary widely, including various sprays for industrial uses, agricultural uses, equipment uses, home uses, and individual uses, such as painting, coating, pesticide spraying, washing, humidifying, sprinklers, disinfection spray, and cooling. Therefore, it is possible to apply the invention to such spray apparatus regardless of the driving source, nozzle configuration, and sprayed fluid, to realize a spray configuration that has not yet been possible.

Various modifications and alterations of this invention will be apparent to those skilled in the art without departing from the scope and spirit of this invention, and it should be understood that this is not limited to the illustrative embodiments set forth herein.

What is claimed is:

1. A method of generating a spray by a fluid injection valve comprising orifices, the method comprising:

forming a relatively faster flow and a relatively slower flow in a corresponding orifice, wherein the faster flow is configured to press a fuel into an inner surface of the corresponding orifice, due to a faster speed and in response to an air entering the corresponding orifice between the faster flow and the inner surface of the corresponding orifice, wherein the fuel is spread forming a liquid film in each of the orifices, injecting the liquid film as individual jet flows from the orifices positioned on an orifice plate proximate one another along a curve, thereby forming a column underneath the orifices comprising adjacent individual jet flows at a circumference of the column and an internal air region surrounded by inner surfaces of the individual jet flows, as seen in a direction down from the orifices, wherein the injected liquid film travels a predetermined distance and starts to split, whereby atomized liquid drops are generated, inducing the Coanda effect by creating a difference between an internal air pressure in the internal air region and an external air pressure on an outside of outer surfaces of the individual jet flows;

causing the adjacent individual jet flows injected from each of the orifices to start converging by the Coanda effect acting on the individual jet flows at a position of a break-up length; and allowing a convergence of the individual jet flows to continue until the Coanda effect disappears, thereby generating a spray from the individual jet flows at a downstream position farther than the position of the break-up length, wherein the forming the relatively faster flow and the relatively slower flow comprises:

generating a back-flow by changing a travel direction of a portion of the fuel, after passing an inlet of the orifice, to an opposite direction by collision with a surface disposed beyond an inlet of the orifice, while allowing another portion of the fuel to travel in a same travel direction and flow directly into the inlet of the orifice, wherein the back-flow is generated with a reduced speed, thereby forming the relatively slower flow, and the another portion of the fuel attains a relatively greater speed due to the reduced speed of the portion of the fuel forming the back-flow.

2. The method of generating a spray by a fluid injection valve, according to claim 1, wherein the individual jet flows interfere with each other in a range of from the position of the break-up length to a position of two times the break-up length.

3. The method of generating a spray by a fluid injection valve, according to claim 1, wherein:

each of the jet flows from each of the orifices of the fluid injection valve has a cross sectional shape in a substantially ellipsoidal shape or in a substantially crescent shape; and an aspect ratio thereof is set relatively greater with respect to 1.

4. The method of generating a spray by a fluid injection valve, according to claim 3, wherein the aspect ratio is set to 1.5 or greater.

5. The method of generating a spray by a fluid injection valve, according to claim 1, wherein:

each of the jet flows from each of the orifices of the fluid injection valve has a cross-sectional shape in a substantially ellipsoidal shape or in a substantially crescent shape; and the spray is formed in a polygonal cross-sectional shape.

6. The method of generating a spray by a fluid injection valve, according to claim 5, wherein the spray having a polygonal cross-sectional shape is formed by connecting extension lines of the major axes of the substantially ellipsoidal shapes or the curved portion tangent lines of the substantially crescent shapes, each of which being the jet flow cross-sectional shape, to form sides of a substantially polygonal shape, or by allowing tip portions of the substantially ellipsoidal shapes or the substantially crescent shapes to be vertexes of the substantially polygonal shape.

7. The method of generating a spray by a fluid injection valve, according to claim 1, wherein, in a two-direction spray port injection system, the aspect ratio of the cross-sectional shape of the jet flows directly below each of the orifices of the fluid injection valve is greater than 1.5.

8. The method of generating a spray by a fluid injection valve, according to claim 1, wherein, in a one-direction spray port injection system, the jet flows directly below each of the orifices of the fluid injection valve have a cross-sectional shape in a substantially ellipsoidal shape or in a substantially crescent shape, and the major axis components thereof or the curved portion tangent line components thereof are disposed at a substantially equal gap along a substantially circumferential direction.

9. The method of generating a spray by a fluid injection valve, according to claim 3 wherein the jet flows directly below each of the orifices of the fluid injection valve have a cross-sectional shape in a substantially ellipsoidal shape or in a substantially crescent shape, and the major axis components thereof or the curved portion tangent line components thereof are formed in a substantially radial shape or in a substantially windmill shape.

10. The method of generating a spray by a fluid injection valve, according to claim 3, wherein:

a converged spray is formed by converging the jet flows having a cross-sectional shape in a substantially circular shape or in an elliptical shape;

an injection amount distribution in the cross section of the converged spray is a substantially conical distribution having a peak substantially in a vicinity of a center at a location where the Coanda effect is almost lost; and a spread of the converged spray lies inside an outer envelope of a virtual entire spray formed by connecting virtual single contours of the jet flows estimated from the directions or the outermost peripheral portions of each of the jet flows being in the substantially ellipsoidal shape or in the substantially crescent shape.

11. The method of generating a spray by a fluid injection valve, according to claim 10, wherein the converged spray approximately satisfies the expression $d2<\frac{1}{2}d1$, where d1 and d2 are diameters of respective circular shapes corresponding to an outer envelope and an inner envelope of each spray contour as viewed in a cross-section perpendicular to a spray direction at a position where the spray contours start to interfere with each other, the outer envelope and the inner envelope being assumed to be in a substantially circular shape.

12. The method of generating a spray by a fluid injection valve, according to claim 3, wherein the major axis components of the substantially ellipsoidal shapes or the curved portion tangent line components of each of the substantially crescent shapes in the cross-sectional shape of the jet flows are brought proximate to each other to converge in a substantially linear shape or in a substantially curved shape.

13. The method of generating a spray by a fluid injection valve according to claim 3, wherein:

a converged spray is formed by converging the jet flows having a cross-sectional shape in a substantially ellipsoidal shape;

an injection amount distribution in a cross section of the converged spray is a substantially ellipsoidal distribution at a location where the Coanda effect is almost lost; and a spread of the converged spray along the minor axis thereof is shorter than the minor axis length of a virtual entire spray formed by connecting virtual single spray contours estimated from directions of the jet flows being in each substantially ellipsoidal shape or in each substantially crescent shape.

14. The method of generating a spray by a fluid injection valve, according to claim 13, wherein the converged spray approximately satisfies the expression $d4<\frac{1}{2}d3$, where d3 and d4 are main axis length and minor axis length respectively of each spray contour as viewed in a cross-section perpendicular to a spray direction at a position where the spray contours start to interfere with each other, the outer envelope and the inner envelope being assumed to be in a substantially circular shape.

15. The method of generating a spray by a fluid injection valve, according to claim 1, wherein a converged spray formed by converging the jet flows having a penetration distance that starts to reduce suddenly from a location or in a vicinity of the location where the Coanda effect almost loses its effect.

16. The method of generating a spray by a fluid injection valve, according to claim 1, wherein a plurality of portions are provided having almost no pressure difference between an inside and an outside of an entire converged spray formed by converging the flow jets.

17. A fluid injection valve comprising:

a valve seat having a valve seat face in a midpoint of a fluid passage;

a valve body for controlling opening/closing of the fluid passage by seating/unseating to the valve seat face;

an orifice plate located downstream from the valve seat and having orifices positioned proximate one another along a curve;

a cover plate which is provided within the valve seat on an upstream of the orifice plate and comprises a bottom portion which is disposed on the orifice plate and comprises an end face, and a wall portion comprising a bottom side which is adjacent the end face;

a shoulder which is formed on the orifice plate and disposed between an inlet of a corresponding orifice and the end face; and a void formed between the bottom side of the wall portion, the end face, and the orifice plate, wherein a portion of a fuel in the fluid passage travels via the void directly into the corresponding orifice on a side distal to the end face and a portion of the fuel travels along the void to the end face and is directed back by the end face along the shoulder as a back-flow and into an inner surface of the corresponding orifice on a side proximate the end face, to generate a relatively slower flow as compared to the portion of the fuel which travels via the void directly into the corresponding orifice to generate a relatively faster flow, and the faster flow is configured to press the fuel into the inner surface of the corresponding orifice on the side proximate the end face, due a faster speed and in response to an air entering the corresponding orifice between the faster flow and the inner surface of the corresponding orifice on the side distal the end face, wherein the fuel is spread forming a liquid film in each of the orifices, each of the orifices is configured to inject the liquid film as an individual jet flow, wherein the liquid film travels a predetermined distance from the orifice and starts to split, whereby atomized liquid drops are generated, the individual jet flows are configured to start converging by a Coanda effect acting on adjacent individual jet flows at a position of a break-up length, and form a column underneath the orifices comprising the adjacent individual jet flows at a circumference of the column and an internal air region surrounded by inner surfaces of the individual jet flows, as seen in a direction down from the orifices, a convergence of the individual jet flows is continued until the Coanda effect disappears, thereby a spray from the individual jet flows is generated at a downstream position farther than the position of the break-up length, and the Coanda effect is induced by creating a difference between an internal air pressure in the internal air region and an external air pressure on an outside of outer surfaces of the individual jet flows.

18. The fluid injection valve according to claim 17, wherein a spray direction length at which the Coanda effect disappears, or a spray direction length at which the spray suddenly starts to reduce a penetration distance, is adjustable according to a length from an injection point to an intake valve, according to a length from the injection point to an intake port wall surface facing a spray tip-end portion, or according to a length from the injection point to a throttle valve facing the spray tip-end portion, and the Coanda effect disappears in response to the internal air pressure becoming substantially equal to the external air pressure.

19. A fluid injection valve according to claim 17, further comprising a tip portion which is fitted at a downstream-side position of a throttle valve and is inclined toward an upstream side of the throttle valve so that fuel is injected toward an upstream of intake air flow.

20. A spray generation apparatus comprising the fluid injection valve according to claim 17.

21. The method of generating a spray by a fluid injection valve according to claim 1, wherein the individual jet flows are atomized prior to being subjected to the Coanda effect.

* * * * *